US006159918A

United States Patent [19]

Bae-Lee et al.

[11] Patent Number: 6,159,918

[45] **Date of Patent: *Dec. 12, 2000**

[54] TRANSPARENT/TRANSLUCENT LIQUID ENZYME COMPOSITIONS IN CLEAR BOTTLES COMPRISING UV ABSORBER

[75] Inventors: Myongsuk Bae-Lee, Montville; Feng-Lung Gordon Hsu, Tenafly; Dennis Stephen Murphy, Leonia; Kristina Marie Neuser, Cliffside Park, all of N.J.

[73] Assignee: Unilever Home & Personal Care U.S.A., division of Conopco, Inc., Greenwich, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 09/212,982

[22] Filed: Dec. 16, 1998

[51] Int. Cl.[7] ..... C11D 17/00; C11D 3/00

[52] U.S. Cl. ..... 510/293; 393/394; 393/320; 393/321; 393/406

[58] Field of Search ..... 510/392, 422, 510/424, 426, 406, 293, 383, 393, 394, 319, 321

[56] References Cited

U.S. PATENT DOCUMENTS

| | | | |
|---|---|---|---|
| 2,379,942 | 7/1945 | Webber . | |
| 2,503,280 | 4/1950 | Lockwood . | |
| 2,507,088 | 5/1950 | Bradley . | |
| 2,612,510 | 9/1952 | Hatcher et al. . | |
| 2,784,220 | 3/1957 | Spiegler . | |
| 3,260,741 | 7/1966 | Mackhinon et al. . | |
| 3,308,067 | 3/1967 | Diehl . | |
| 3,372,188 | 3/1968 | Alston et al. . | |
| 3,630,929 | 12/1971 | Brand Van Dijk . | |
| 3,755,201 | 8/1973 | Trimmer et al. | 252/526 |
| 3,812,042 | 5/1974 | Verdier . | |
| 3,817,042 | 6/1974 | Sanderson . | |
| 4,062,647 | 12/1977 | Storm et al. . | |
| 4,136,812 | 1/1979 | Bellis . | |
| 4,302,364 | 11/1981 | Gosset et al. | 252/545 |
| 4,316,812 | 2/1982 | Hancock et al. . | |
| 4,497,718 | 2/1985 | Neiditch et al. . | |
| 4,556,504 | 12/1985 | Rek . | |
| 4,919,834 | 4/1990 | Chen et al. . | |
| 4,919,846 | 4/1990 | Nakama et al. | 252/542 |
| 5,082,578 | 1/1992 | Langer et al. . | |
| 5,147,576 | 9/1992 | Montague et al. . | |
| 5,200,236 | 4/1993 | Langer et al. . | |
| 5,205,960 | 4/1993 | Kristopeit et al. . | |
| 5,226,538 | 7/1993 | Roselle . | |
| 5,290,475 | 3/1994 | Wixon . | |
| 5,312,954 | 5/1994 | Breuer et al. . | |
| 5,330,672 | 7/1994 | Langer et al. . | |
| 5,389,279 | 2/1995 | Au et al. . | |
| 5,397,493 | 3/1995 | Potocki | 252/89.1 |
| 5,427,708 | 6/1995 | Stark . | |
| 5,466,354 | 11/1995 | Leonida et al. . | |
| 5,529,122 | 6/1996 | Thach . | |
| 5,542,950 | 8/1996 | Cole et al. . | |
| 5,562,848 | 10/1996 | Wofford et al. . | |
| 5,573,707 | 11/1996 | Cole et al. . | |
| 5,622,925 | 4/1997 | de Buzzaccarini et al. . | |
| 5,733,763 | 3/1998 | Markussen et al. . | |
| 5,783,547 | 7/1998 | Wilkinson . | |
| 5,853,430 | 12/1998 | Shindo et al. . | |

FOREIGN PATENT DOCUMENTS

| | | |
|---|---|---|
| 154269 | 1/1978 | Denmark . |
| 239 119 | 9/1987 | European Pat. Off. . |
| 258068 | 3/1988 | European Pat. Off. . |
| 461537A2 | 12/1991 | European Pat. Off. . |
| 913 462 | 5/1999 | European Pat. Off. . |
| 401413 | 11/1933 | United Kingdom . |
| 461221 | 2/1937 | United Kingdom . |
| 1303810 | 1/1973 | United Kingdom . |
| 1429143 | 3/1976 | United Kingdom . |
| 1470250 | 4/1977 | United Kingdom . |
| 2131826 | 6/1984 | United Kingdom . |
| 2172608 | 9/1986 | United Kingdom . |
| 2228940 | 9/1990 | United Kingdom . |
| 94/11485 | 5/1994 | WIPO . |
| 97/26315 | 7/1997 | WIPO . |
| 98/53035 | 11/1998 | WIPO . |

*Primary Examiner*—Necholus Ogden
*Attorney, Agent, or Firm*—Rimma Mitelman

[57] ABSTRACT

An enzyme containing translucent or transparent aqueous heavy duty liquid in a clear bottle comprising fluorescent dye and/or UV absorber.

2 Claims, No Drawings

TRANSPARENT/TRANSLUCENT LIQUID ENZYME COMPOSITIONS IN CLEAR BOTTLES COMPRISING UV ABSORBER

FIELD OF THE INVENTION

The present invention relates to enzyme-containing aqueous, transparent or translucent heavy duty liquid laundry detergents in transparent or translucent bottles comprising f-dyes and/or UV absorbers. The f-dyes and/or UV absorbers protect enzymes present in the HDL composition from damage by harmful UV radiation thereby preserving the enzyme activity.

BACKGROUND OF THE INVENTION

Liquid detergents have traditionally been sold in opaque bottles. However, use of clear bottles can be aesthetically appealing to consumers as they can see the consistency of product, and suspended particles if they are present. However, the use of clear bottles can lead to the undesirable loss of enzyme activity (i.e., enzymes present in the liquid compositions) by UV light. By UV light is meant light having wavelength of about 250 to about 460 nanometers (nm). Specifically, UVA generally is in range 320–400 nm, UVB about 290 to 320 nm and UVC below 290 nm, down to about 250 nm.

It has been known in the art that UV absorbers can be added to the bottle material during manufacture of clear bottles to protect them from becoming brittle and to protect the ingredients inside the bottle. For instance, in GB 2228940 the use of a dicarboxylate in polyester bottles to protect contents—mainly food—from 320–360 nm is described.

In EU 0461537A2 the use of film formers for blocking UV radiation from passing through glass bottles is described. While use of such ingredients can block the transmission of UV light through clear bottles, UV absorbers for inclusion in bottle material are expensive, and must be added when bottle material is hot and molten and there is the risk of burning the operator.

WO 97/26315 (to Colgate) discloses transparent containers with specific chromaticity defined by x and y values. Specific dyes are used in the liquid to maintain the container. The reference neither teaches nor suggests transparent liquids with the specific combination of f-dyes and enzyme.

GB 1,303,810 discloses clear liquid medium and visually distinct components suspended in the medium. Detergent compositions containing f-dyes and enzyme capsule are not disclosed.

U.S. Pat. No. 3,812,042 to Verdier discloses clear packages containing liquids with a viscosity and clarity control system comprising urea, lower aliphatic alcohol and optional hydrotrope.

BRIEF DESCRIPTION OF THE INVENTION

It has now surprisingly been found that a relatively small amount of f-dye or UV absorber, when added to a liquid containing enzymes, has the ability to dramatically reduce the loss of activity by UV light. This is unexpected in that the level of additive is small (0.001 to about 3%) and is dispersed throughout the liquid matrix. The use of f-dye has the advantage that is an ingredient already frequently used in HDL's and thus adds little or no additional cost, and it can be added at lower temperatures for safety than found with molten bottle materials. UV absorber added to the HDL has the advantage that it can be added at lower and safer temperatures than adding UV absorber to molten bottle material.

DETAILED DESCRIPTION OF THE INVENTION

The invention relates to enzyme containing transparent/translucent liquid duty liquids in clear bottles comprising relatively small amounts of f-dye or UV absorber to protect against loss of enzyme activity (e.g., caused by the light hitting enzyme through the clear bottle).

UV Absorbers

Among families of UV absorbers which may be used are benzophenones, salicylates, benzotriazoles, hindered amines and alkoxy (e.g., methoxy) cinnamates. Recitation of these classes is not meant to be a limitation on other classes of UV absorbers which may be used.

Water soluble UV absorbers particularly useful for this application include, but are not limited to: phenyl benzimidazole sulfonic acid (sold as Neo Heliopan, Type Hydro by Haarmann and Reimer Corp.), 2-hydroxy-4-methoxybenzophenone-5-sulfonic acid (sold as Syntase 230 by Rhone-Poulenc and Uvinul MS-40 by BASF Corp.), sodium 2,2'-dihydroxy-4,4'-dimethoxy-5-sulfobenzophenone (sold as Uvinul DS-49 by BASF Corp.), and PEG-25 paraaminobenzoic acid (sold as Uvinul P-25 by Basf Corp.).

Other UV absorbers which may be used are defined in McCutcheon's Volume 2, Functional Materials, North American Edition, published by the Manufacturing Confectioner Publishing Company (1997), a copy of which is hereby incorporated by reference into the subject application.

UV absorber may be present in the formulation with or without F-dye. UV absorber is used in the formulation from about 0.001% to about 3%, preferably between 0.05% and 1%.

Fluorescent Dyes

Classes of fluorescent dyes which may be used include stilbeness; coumarin and carbostyril compounds; 1,3-diphenyl-2-pyrazolines; naphthalimides; benzadyl substitution products of ethylene, phenylethylene, stilbene, thiophene; and combined hateroaromatics.

Among fluorescent dyes which may be used are also the sulfonic acid salts of diamino stilbene derivatives such as taught in U.S. Pat. No. 2,784,220 to Spiegler or U.S. Pat. No. 2,612,510 to Wilson et al., both of which are hereby incorporated by reference. Polymeric fluorescent whitening agent as taught in U.S. Pat. No. 5,082,578, hereby incorporated by reference into the subject application, are also contemplated by this invention.

Finally, other dyes which may be used are defined in McCutcheon's Volume 2, Functional Materials, North American Edition as noted above in connection with UV absorbers.

Fluorescent dyes particularly useful for this application include, but are not limited to: the distyrylbiphenyl types such as Tinopal CBS-X from Ciba Geigy Corp. and the cyanuric chloride/diaminostilbene types such as Tinopal AMS, DMS, 5BM, and UNPA from Ciba Geigy Corp. and Blankophor DML from Mobay. Fluorescent dye may be present in the formulation with or without UV absorbing. F-dye is used in the formulation from about 0.001% to about 3%, preferably between 0.05% and 0.5%.

Detergent Compositions

Detergent Active

The compositions of the invention contains one or more surface active agents (surfactants) selected from the group consisting of anionic, nonionic, cationic, ampholytic and zwitterionic surfactants or mixtures thereof. The preferred surfactant detergents for use in the present invention are mixtures of anionic and nonionic surfactants although it is to be understood that any surfactant may be used alone or in combination with any other surfactant or surfactants. The surfactant should comprise at least 10% by wt. of the composition, e.g., 11% to 75%, preferably at least 15% to 70% of the total composition, more preferably 16% to 65%; even more preferably 20% to 65%.

Nonionic Surfactant

Nonionic synthetic organic detergents which can be used with the invention, alone or in combination with other surfactants, are described below.

As is well known, the nonionic detergents are characterized by the presence of an organic hydrophobic group and an organic hydrophilic group and are typically produced by the condensation of an organic aliphatic or alkyl aromatic hydrophobic compound with ethylene oxide (hydrophilic in nature). Typical suitable nonionic surfactants are those disclosed in U.S. Pat. Nos. 4,316,812 and 3,630,929.

Usually, the nonionic detergents are polyalkoxylated lipophiles wherein the desired hydrophile-lipophile balance is obtained from addition of a hydrophilic poly-lower alkoxy group to a lipophilic moiety. A preferred class of nonionic detergent is the alkoxylated alkanols wherein the alkanol is of 9 to 18 carbon atoms and wherein the number of moles of alkylene oxide (of 2 or 3 carbon atoms) is from 3 to 12. Of such materials it is preferred to employ those wherein the alkanol is a fatty alcohol of 9 to 11 or 12 to 15 carbon atoms and which contain from 5 to 8 or 5 to 9 alkoxy groups per mole.

Exemplary of such compounds are those wherein the alkanol is of 12 to 15 carbon atoms and which contain about 7 ethylene oxide groups per mole, e.g. Neodol 25-7 and Neodol 23-6.5, which products are made by Shell Chemical Company, Inc. The former is a condensation product of a mixture of higher fatty alcohols averaging about 12 to 15 carbon atoms, with about 7 moles of ethylene oxide and the latter is a corresponding mixture wherein the carbon atoms content of the higher fatty alcohol is 12 to 13 and the number of ethylene oxide groups present averages about 6.5. The higher alcohols are primary alkanols.

Other useful nonionics are represented by the commercially well-known class of nonionics sold under the trademark Plurafac. The Plurafacs are the reaction products of a higher linear alcohol and a mixture of ethylene and propylene oxides, containing a mixed chain of ethylene oxide and propylene oxide, terminated by a hydroxyl group. Examples include $C_{13}$–$C_{15}$ fatty alcohol condensed with 6 moles ethylene oxide and 3 moles propylene oxide, $C_{13}$–$C_{15}$ fatty alcohol condensed with 7 moles propylene oxide and 4 moles ethylene oxide, $C_{13}$–$C_{15}$ fatty alcohol condensed with 5 moles propylene oxide and 10 moles ethylene oxide, or mixtures of any of the above.

Another group of liquid nonionics are commercially available from Shell Chemical Company, Inc. under the Dobanol trademark: Dobanol 91-5 is an ethoxylated $C_9$–$C_{11}$ fatty alcohol with an average of 5 moles ethylene oxide and Dobanol 23-7 is an ethoxylated $C_{12}$–$C_{15}$ fatty alcohol with an average of 7 moles ethylene oxide per mole of fatty alcohol.

In the compositions of this invention, preferred nonionic surfactants include the $C_{12}$–$C_{15}$ primary fatty alcohols with relatively narrow contents of ethylene oxide in the range of from about 7 to 9 moles, and the $C_9$ to $C_{11}$ fatty alcohols ethoxylated with about 5–6 moles ethylene oxide.

Another class of nonionic surfactants which can be used in accordance with this invention are glycoside surfactants. Glycoside surfactants suitable for use in accordance with the present invention include those of the formula:

$$RO—R'O—_y(Z)_x$$

wherein R is a monovalent organic radical containing from about 6 to about 30 (preferably from about 8 to about 18) carbon atoms; R' is a divalent hydrocarbon radical containing from about 2 to 4 carbons atoms; 0 is an oxygen atom; y is a number which can have an average value of from 0 to about 12 but which is most preferably zero; Z is a moiety derived from a reducing saccharide containing 5 or 6 carbon atoms; and x is a number having an average value of from 1 to about 10 (preferably from about 1.5 to about 10).

A particularly preferred group of glycoside surfactants for use in the practice of this invention includes those of the formula above in which R is a monovalent organic radical (linear or branched) containing from about 6 to about 1 8(especially from about 8 to about 18) carbon atoms; y is zero; z is glucose or a moiety derived therefrom; x is a number having an average value of from 1 to about 4 (preferably from about 1 to 4).

Nonionic surfactants particularly useful for this application include, but are not limited to: alcohol ethoxylates (e.g. Neodol 25-9 from Shell Chemical Co.), alkyl phenol ethoxylates (e.g. Tergitol NP-9 from Union Carbide Corp.), alkylpolyglucosides (e.g. Glucapon 600CS from Henkel Corp.), polyoxyethylenated polyoxypropylene glycols (e.g. Pluronic L-65 from BASF Corp.), sorbitol esters (e.g. Emsorb 2515 from Henkel Corp.), polyoxyethylenated sorbitol esters (e.g. Emsorb 6900 from Henkel Corp.), alkanolamides (e.g. Alkamide DC212/SE from Rhone-Poulenc Co.), and N-alkypyrrolidones (e.g. Surfadone LP-100 from ISP Technologies Inc.).

Nonionic surfactant is used in the formulation from about 0% to about 70%, preferably between 5% and 50%, more preferably 10–40% by weight.

Mixtures of two or more of the nonionic surfactants can be used.

Anionic Surfactant Detergents

Anionic surface active agents which may be used in the present invention are those surface active compounds which contain a long chain hydrocarbon hydrophobic group in their molecular structure and a hydrophilic group, i.e.; water solubilizing group such as sulfonate or sulfate group. The anionic surface active agents include the alkali metal (e.g. sodium and potassium) water soluble higher alkyl benzene sulfonates, alkyl sulfonates, alkyl sulfates and the alkyl polyether sulfates. They may also include fatty acid or fatty acid soaps. The preferred anionic surface active agents are the alkali metal, ammonium or alkanolamide salts of higher alkyl benzene sulfonates and alkali metal, ammonium or alkanolamide salts of higher alkyl sulfonates. Preferred higher alkyl sulfonates are those in which the alkyl groups contain 8 to 26 carbon atoms, preferably 12 to 22 carbon atoms and more preferably 14 to 18 carbon atoms. The alkyl group in the alkyl benzene sulfonate preferably contains 8 to 16 carbon atoms and more preferably 10 to 15 carbon atoms. A particularly preferred alkyl benzene sulfonate is the sodium or potassium dodecyl benzene sulfonate, e.g. sodium linear dodecyl benzene sulfonate. The primary and secondary alkyl sulfonates can be made by reacting long chain alpha-olefins with sulfites or bisulfites, e.g. sodium bisulfite. The alkyl sulfonates can also be made by reacting long chain normal paraffin hydrocarbons with sulfur dioxide and oxygen as described in U.S. Pat. Nos. 2,503,280, 2,507,088, 3,372,188 and 3,260,741 to obtain normal or secondary higher alkyl sulfonates suitable for use as surfactant detergents.

The alkyl substituent is preferably linear, i.e. normal alkyl, however, branched chain alkyl sulfonates can be employed, although they are not as good with respect to biodegradability. The alkane, i.e. alkyl, substituent may be terminally sulfonated or may be joined, for example, to the carbon atom of the chain, i.e. may be a secondary sulfonate. It is understood in the art that the substituent may be joined to any carbon on the alkyl chain. The higher alkyl sulfonates can be used as the alkali metal salts, such as sodium and potassium. The preferred salts are the sodium salts. The preferred alkyl sulfonates are the C10 to C18 primary normal alkyl sodium and potassium sulfonates, with the C10 to C15 primary normal alkyl sulfonate salt being more preferred.

Mixtures of higher alkyl benzene sulfonates and higher alkyl sulfonates can be used as well as mixtures of higher alkyl benzene sulfonates and higher alkyl polyether sulfates.

The alkali metal alkyl benzene sulfonate can be used in an amount of 0 to 70%, preferably 10 to 50% and more preferably 10 to 20% by weight.

The alkali metal sulfonate can be used in admixture with the alkylbenzene sulfonate in an amount of 0 to 70%, preferably 10 to 50% by weight.

Also normal alkyl and branched chain alkyl sulfates (e.g., primary alkyl sulfates) may be used as the anionic component).

The higher alkyl polyether sulfates used in accordance with the present invention can be normal or branched chain alkyl and contain lower alkoxy groups which can contain two or three carbon atoms. The normal higher alkyl polyether sulfates are preferred in that they have a higher degree of biodegradability than the branched chain alkyl and the lower poly alkoxy groups are preferably ethoxy groups.

The preferred higher alkyl poly ethoxy sulfates used in accordance with the present invention are represented by the formula:

$$R'—O(CH_2CH_2O)_p—SO_3M,$$

where R' is $C_8$ to $C_{20}$ alkyl, preferably $C_{10}$to $C_{18}$ and more preferably $C_{12}$ to $C_{15}$;P is 2 to 8, preferably 2 to 6, and more preferably 2 to 4;and M is an alkali metal, such as sodium and potassium, or an ammonium cation. The sodium and potassium salts are preferred.

A preferred higher alkyl poly ethoxylated sulfate is the sodium salt of a triethoxy $C_{12}$ to $C_{15}$ alcohol sulfate having the formula:

$$C_{12-15}—O—(CH_2CH_2O)_3—SO_3Na$$

Examples of suitable alkyl ethoxy sulfates that can be used in accordance with the present invention are $C_{12-15}$ normal or primary alkyl triethoxy sulfate, sodium salt; n-decyl diethoxy sulfate, sodium salt; $C_{12}$ primary alkyl diethoxy sulfate, ammonium salt; $C_{12}$ primary alkyl triethoxy sulfate, sodium salt: $C_{15}$ primary alkyl tetraethoxy sulfate, sodium salt, mixed $C_{14-15}$ normal primary alkyl mixed tri- and tetraethoxy sulfate, sodium salt; stearyl pentaethoxy sulfate, sodium salt; and mixed $C_{10-18}$ normal primary alkyl triethoxy sulfate, potassium salt.

The normal alkyl ethoxy sulfates are readily biodegradable and are preferred. The alkyl poly-lower alkoxy sulfates can be used in mixtures with each other and/or in mixtures with the above discussed higher alkyl benzene, alkyl sulfonates, or alkyl sulfates.

The alkali metal higher alkyl poly ethoxy sulfate can be used with the alkylbenzene sulfonate and/or with an alkyl sulfonate or sulfonate, in an amount of 0 to 70%, preferably 10 to 50% and more preferably 10 to 20% by weight of entire composition.

Anionic surfactants particularly useful for this application include, but are not limited to: linear alkyl benzene sulfonates (e.g. Vista C-500 from Vista Chemical Co.), alkyl sulfates (e.g. Polystep B-5 from Stepan Co.), polyoxyethylenated alkyl sulfates (e.g. Standapol ES-3 from Stepan Co.), alpha olefin sulfonates (e.g. Witconate AOS from Witco Corp.), alpha sulfo methyl esters (e.g. Alpha-Step MC-48 from Stepan Co.) and isethionates (e.g. Jordapon Cl from PPG Industries Inc.).

Anionic surfactant is used in the formulation from about 0% to about 60%, preferably between 5% and 40%, more preferably 8 to 25% by weight.

Cationic Surfactants

Many cationic surfactants are known in the art, and almost any cationic surfactant having at least one long chain alkyl group of about 10 to 24 carbon atoms is suitable in the present invention. Such compounds are described in "Cationic Surfactants", Jungermann, 1970, incorporated by reference.

Specific cationic surfactants which can be used as surfactants in the subject invention are described in detail in U.S. Pat. No. 4,497,718, hereby incorporated by reference.

As with the nonionic and anionic surfactants, the compositions of the invention may use cationic surfactants alone or in combination with any of the other surfactants known in the art. Of course, the compositions may contain no cationic surfactants at all.

Amphoteric Surfactants

Ampholytic synthetic detergents can be broadly described as derivatives of aliphatic or aliphatic derivatives of heterocyclic secondary and tertiary amines in which the aliphatic radical may be a straight chain or a branched and wherein one of the aliphatic substituents contains from about 8 to 18 carbon atoms and at least one contains an anionic water-solubilizing group, e.g. carboxy, sulfonate, sulfate. Examples of compounds falling within this definition are sodium 3(dodecylamino)propionate, sodium 3-(dodecylamino)propane-1-sulfonate, sodium 2-(dodecylamino)ethyl sulfate, sodium 2-(dimethylamino) octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis(2-hydroxyethyl)-2-sulfato-3-dodecoxypropylamine. Sodium 3-(dodecylamino)propane-l-sulfonate is preferred.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent containing an anionic water solubilizing group, e.g., carboxy, sulfonate, sulfate, phosphate, or phosphonate.

Specific examples of zwitterionic surfactants which may be used are set forth in U.S. Pat. No. 4,062,647, hereby incorporated by reference.

The amount of amphoteric used may vary from 0 to 50% by weight, preferably 1 to 30% by weight.

It should be noted that the compositions of the invention are preferably isotropic (by which is generally understood to be a homogenous phase when viewed macroscopically) and either transparent or translucent.

Total surfactant used must be at least 10%, preferably at least 15%, more preferably at least 20% by wt.

Builders/Electrolyte

Builders which can be used according to this invention include conventional alkaline detergency builders, inorganic or organic, which can be used at levels from about 0% to about 50% by weight of the composition, preferably from 3% to about 35% by weight.

As used herein, the term electrolyte means any water-soluble salt.

Preferably the composition comprises at least 1.0% by weight, more preferably at least 5.0% by weight, most preferably at least 10.0% by weight of electrolyte. The electrolyte may also be a detergency builder, such as the inorganic builder sodium tripolyphosphate, or it may be a non-functional electrolyte such as sodium sulfate or chloride. Preferably the inorganic builder comprises all or part of the electrolyte.

The composition may comprise at least about 1%, preferably at least about 3%, preferably 3% to as much as about 50% by weight electrolyte.

The compositions of the invention are capable of suspending particulate solids, although particularly preferred are those systems where such solids are actually in suspension. The solids may be undissolved electrolyte, the same as or different from the electrolyte in solution, the latter being saturated electrolyte. Additionally, or alternatively, they may be materials which are substantially insoluble in water alone. Examples of such substantially insoluble materials are aluminosilicate builders and particles of calcite abrasive.

Examples of suitable inorganic alkaline detergency builders which may be used are water-soluble alkali metal phosphates, polyphosphates, borates, silicates and also carbonates. Specific examples of such salts are sodium and potassium triphosphates, pyrophosphates, orthophosphates, hexametaphosphates, tetraborates, silicates, and carbonates.

Examples of suitable organic alkaline detergency builder salts are: (1) water-soluble amino polycarboxylates, e.g., sodium and potassium ethylenediaminetetraacetates, nitrilotriacetates and N-(2 hydroxyethyl)- nitrilodiacetates; (2) water-soluble salts of phytic acid, e.g., sodium and potassium phytates (see U.S. Pat. No. 2,379,942); (3) water-soluble polyphosphonates, including specifically, sodium, potassium and lithium salts of ethane-1-hydroxy-l,1-diphosphonic acid; sodium, potassium and lithium salts of methylene diphosphonic acid; sodium, potassium and lithium salts of ethylene diphosphonic acid; and sodium, potassium and lithium salts of ethane-l,l,2-triphosphonic acid. Other examples include the alkali metal salts of ethane-2-carboxy-l,l-diphosphonic acid hydroxymethanediphosphonic acid, carboxyldiphosphonic acid, ethane-1-hydroxy-l,l,2-triphosphonic acid, ethane-2-hydroxy-1,l,2-triphosphonic acid, propane-1,1,3,3-tetraphosphonic acid, propane-1,1,2,3-tetraphosphonic acid, and propane-1,2,2,3-tetra-phosphonic acid; (4) water-soluble salts of polycarboxylates polymers and copolymers as described in U.S. Pat. No. 3,308,067.

In addition, polycarboxylate builders can be used satisfactorily, including water-soluble salts of mellitic acid, citric acid, and carboxymethyloxysuccinic acid, salts of polymers of itaconic acid and maleic acid, tartrate monosuccinate, tartrate disuccinate and mixtures thereof (TMS/TPS).

Certain zeolites or aluminosilicates can be used. One such aluminosilicate which is useful in the compositions of the invention is an amorphous water-insoluble hydrated compound of the formula $Na_x[(AlO_2)_y.SiO_2)$, wherein x is a number from 1.0 to 1.2 and y is 1, said amorphous material being further characterized by a Mg++ exchange capacity of from about 50 mg eq. $CaCO_3$/g. and a particle diameter of from about 0.01 mm to about 5 mm. This ion exchange builder is more fully described in British Patent No. 1,470,250.

A second water-insoluble synthetic aluminosilicate ion exchange material useful herein is crystalline in nature and has the formula $Na_z[(AlO_2)_y(SiO_2)]_xH_2O$, wherein z and y are integers of at least 6;the molar ratio of z to y is in the range from 1.0 to about 0.5, and x is an integer from about 15 to about 264;said aluminosilicate ion exchange material having a particle size diameter from about 0.1 mm to about 100 mm; a calcium ion exchange capacity on an anhydrous basis of at test about 200 milligrams equivalent of $CaCO_3$ hardness per gram; and a calcium exchange rate on an anhydrous basis of at least about 2 grains/gallon/minute/gram. These synthetic aluminosilicates are more fully described in British Patent No. 1,429,143.

Enzymes

Enzymes which may be used in the subject invention are described in greater detail below.

If a lipase is used, the lipolytic enzyme may be either a fungal lipase producible by *Humicola lanuginosa* and *Thermomyces lanuginosus*, or a bacterial lipase which show a positive immunological cross-reaction with the antibody of the lipase produced by the microorganism Chromobacter viscosum var. lipolyticum NRRL B-3673. This microorganism has been described in Dutch patent specification 154,269 of Toyo Jozo Kabushiki Kaisha and has been deposited with the Fermentation Research Institute, Agency of Industrial Science and Technology, Ministry of International Trade and Industry, Tokyo, Japan, and added to the permanent collection under nr. KO Hatsu Ken Kin Ki 137 and is available to the public at the United States Department of Agriculture, Agricultural Research Service, Northern Utilization and Development Division at Peoria, Ill., USA, under the nr. NRRL B-3673. The lipase produced by this microorganism is commercially available from Toyo Jozo Co., Tagata, Japan, hereafter referred to as "TJ lipase". These bacterial lipases should show a positive immunological cross-reaction with the TJ lipase antibody, using the standard and well-known immune diffusion procedure according to Ouchterlony (Acta. Med. Scan., 133. pages 76–79 (1930).

The preparation of the antiserum is carried out as follows:

Equal volumes of 0.1 mg/ml antigen and of Freund's adjuvant (complete or incomplete) are mixed until an emulsion is obtained. Two female rabbits are injected 45 with 2 ml samples of the emulsion according to the following scheme:

day 0:antigen in complete Freund's adjuvant day 4:antigen in complete Freund's adjuvant day 32:antigen in incomplete Freund's adjuvant day 64:booster of antigen in incomplete Freund's adjuvant The serum containing the required antibody is prepared by centrifugation of clotted blood, taken on day 67.

The titre of the anti-TJ-lipase antiserum is determined by the inspection of precipitation of serial dilutions of antigen and antiserum according to the Ouchteriony procedure. A dilution of antiserum was the dilution that still gave a visible precipitation with an antigen concentration of 0.1 mg/ml.

All bacterial lipases showing a positive immunological cross reaction with the TJ-lipase antibody as hereabove described are lipases suitable in this embodiment of the invention. Typical examples thereof are the lipase ex *Pseudomonas fluorescens* IAM 1057 (available from Amano Pharmaceutical Co., Nagoya, Japan, under the trade-name Amano-P lipase), the lipase ex *Pseudomonas fragi* FERM P 1339 (available under the trade-name Amano B), the lipase ex *Pseudomonas nitroreducens var. lipolyticum* FERM P1338, the lipase ex Pseudomonas sp. (available under the trade-name Amano CES), the lipase ex *Pseudomonas cepacia*, lipases ex Chromobacter viscosum, e.g. *Chromobacter viscosum var. lipolyticum* NRRL B-3673, commercially available from Toyo Jozo Co., Tagata, Japan; and further *Chromobacter viscosum* lipases from U.S. Biochemical Corp. USA and Diosynth Co., The Netherlands, and lipases ex *Pseudomonas gladioli.*

An example of a fungal lipase as defined above is the lipase ex *Humicola lanuginosa* available from Amano under the tradename Amano CE; the lipase ex *Humicola lanuginosa* as described in the aforesaid European Patent Application 0,258,068 (NOVO), as well as the lipase obtained by cloning the gene from *Humicola lanuginosa* and expressing this gene in *Aspergillus oryzae*, commercially available from NOVO industri A/S under the tradename "Lipolase". This lipolase is a preferred lipase for use in the present invention.

While various specific lipase enzymes have been described above, it is to be understood that any lipase which can confer the desired lipolytic activity to the composition may be used and the invention is not intended to be limited in any way by specific choice of lipase enzyme.

The lipases of this embodiment of the invention are included in the liquid detergent composition in such an amount that the final composition has a lipolytic enzyme activity of from 100 to 0.005 LU/ml in the wash cycle, preferably 25 to 0.05 LU/ml when the formulation is dosed at a level of about 0.1–10, more preferably 0.5–7, most preferably 1–2 g/liter.

A Lipase Unit (LU) is that amount of lipase which produces 1/mmol of titratable fatty acid per minute in a pH state under the following conditions: temperature 30° C.; pH=9.0;substrate is an emulsion of 3.3 wt. % of olive oil and 3,3% gum arabic, in the presence of 13 mmol/l $Ca^{2+}$and 20 mmol/l NaCl in 5 mmol/l Trisbuffer.

Naturally, mixtures of the above lipases can be used. The lipases can be used in their non-purified form or in a purified form, e.g. purified with the aid of well-known absorption methods, such as phenyl sepharose absorption techniques.

If a protease is used, the proteolytic enzyme can be of vegetable, animal or microorganism origin. Preferably, it is of the latter origin, which includes yeasts, fungi, molds and bacteria. Particularly preferred are bacterial subtilisin type proteases, obtained from e.g. particular strains of *B. subtilis* and *B licheniformis*. Examples of suitable commercially available proteases are Alcalase, Savinase, Esperase, all of NOVO Industri A/S; Maxatase and Maxacal of Gist-Brocades; Kazusase of Showa Denko; BPN and BPN' proteases and so on. The amount of proteolytic enzyme, included in the composition, ranges from 0.05–50,000 GU/mg. preferably 0.1 to 50 GU/mg, based on the final composition. Naturally, mixtures of different proteolytic enzymes may be used.

While various specific enzymes have been described above, it is to be understood that any protease which can confer the desired proteolytic activity to the composition may be used and this embodiment of the invention is not limited in any way be specific choice of proteolytic enzyme.

In addition to lipases or proteases, it is to be understood that other enzymes such as cellulases, oxidases, amylases, peroxidases and the like which are well known in the art may also be used with the composition of the invention. The enzymes may be used together with cofactors required to promote enzyme activity, i.e., they may be used in enzyme systems, if required. It should also be understood that enzymes having mutations at various positions (e.g., enzymes engineered for performance and/or stability enhancement) are also contemplated by the invention. One example of an engineered commercially available enzyme is Durazym from Novo.

Optional Ingredients

In addition to the enzymes mentioned above, a number of other optional ingredients may be used.

Alkalinity buffers which may be added to the compositions of the invention include monoethanolamine, triethanolamine, borax, sodium silicate and the like.

Hydrotropes which may be added to the invention include ethanol, sodium xylene sulfonate, sodium cumene sulfonate and the like.

Other materials such as clays, particularly of the water-insoluble types, may be useful adjuncts in compositions of this invention. Particularly useful is bentonite. This material is primarily montmorillonite which is a hydrated aluminum silicate in which about ⅙th of the aluminum atoms may be replaced by magnesium atoms and with which varying amounts of hydrogen, sodium, potassium, calcium, etc. may be loosely combined. The bentonite in its more purified form (i.e. free from any grit, sand, etc.) suitable for detergents contains at least 30% montmorillonite and thus its cation exchange capacity is at least about 50 to 75 meg per 100 g of bentonite. Particularly preferred bentonites are the Wyoming or Western U.S. bentonites which have been sold as Thixo-jels 1, 2, 3 and 4 by Georgia Kaolin Co. These bentonites are known to soften textiles as described in British Patent No. 401,413 to Marriott and British Patent No. 461,221 to Marriott and Guam.

In addition, various other detergent additives of adjuvants may be present in the detergent product to give it additional desired properties, either of functional or aesthetic nature.

Improvements in the physical stability and anti-settling properties of the composition may be achieved by the addition of a small effective amount of an aluminum salt of a higher fatty acid, e.g., aluminum stearate, to the composition. The aluminum stearate stabilizing agent can be added in an amount of 0 to 3%, preferably 0.1 to 2.0% and more preferably 0.5 to 1.5%.

There also may be included in the formulation, minor amounts of soil suspending or anti-redeposition agents, e.g. polyvinyl alcohol, fatty amides, sodium carboxymethyl cellulose, hydroxy-propyl methyl cellulose, A preferred anti-redeposition agent is sodium carboxylmethyl cellulose having a 2:1 ratio of CM/MC which is sold under the tradename Relatin DM 4050.

Another minor ingredient is soil releasing agents, e.g. deflocculating polymers. In general, a deflocculating polymer comprises a hydrophilic backbone and one or more hydrophobic side chains.

The deflocculating polymer of the invention is described in greater detail in U.S. Pat. No. 5,147,576 to Montague et al. hereby incorporated by reference into the subject application, The deflocculating polymer generally will comprise, when used, from about 0.1 to about 5% of the composition, preferably 0.1 to about 2% and most preferably, about 0.5 to about 1.5%.

Optical brighteners for cotton, polyamide and polyester fabrics can be used. Suitable optical brighteners include Tinopal, stilbene, triazole and benzidine sulfone compositions, especially sulfonated substituted triazinyl stilbene, sulfonated naphthotriazole stilbene, benzidene sulfone, etc., most preferred are stilbene and triazole combinations. A preferred brightener is Stilbene Brightener N4 which is a dimorpholine dianilino stilbene sulfonate.

Anti-foam agents, e.g. silicone compounds, such as Silicane L 7604, can also be added in small effective amounts.

Bactericides, e.g. tetrachlorosalicylanilide and hexachlorophene, fungicides, dyes, pigments (water dispersible), preservatives, e.g. formalin, ultraviolet absorbers, anti-yellowing agents, such as sodium carboxymethyl cellulose, pH modifiers and pH buffers, color safe bleaches, perfume and dyes and bluing agents such as Iragon Blue L2D, Detergent Blue 472/372 and ultramarine blue can be used.

Also, soil release polymers and cationic softening agents may be used.

The list of optional ingredients above is not intended to be exhaustive and other optional ingredients which may not be listed, but are well known in the art, may also be included in the composition.

Optionally, the inventive compositions may contain all or some the following ingredients: zwitterionic surfactants (e.g. Mirataine BET C-30 from Rhone-Poulenc Co.), cationic surfactants (e.g. Schercamox DML from Scher Chemicals, Inc.), fluorescent dye, antiredeposition polymers, antidye transfer polymers, soil release polymers, protease enzymes, lipase enzymes, amylase enzymes, cellulase enzymes, peroxidase enzymes, enzyme stabilizers, perfume, opacifiers, UV absorbers, builders, and suspended particles of size range 300–5000 microns.

The compositions of the invention have at least 50% transmittance of light using a 1 centimeter cuvette, at a wavelength of 410–800 nanometers, preferably 570–690 nm wherein the composition is substantially free of dyes.

Alternatively, transparency of the composition may be measured as having an absorbency in the visible light wavelength (about 410 to 800 nm) of less than 0.3 which is in turn equivalent to at least 50% transmittance using cuvette and wavelength noted above. For purposes of the invention, as long as one wavelength in the visible light range has greater than 50% transmittance, it is considered to be transparent/translucent.

Enzyme deactivation as a result of UV-damage may occur at very low transmission of UV-B radiation.

Bottle Material

Clear bottle materials with which this invention may be used include, but are not limited to: polypropylene (PP), polyethylene (PE), polycarbonate (PC), polyamides (PA) and/or polyethylene terephthalate (PETE), polyvinylchloride (PVC); and polystyrene (PS).

The transparent container according to the invention preferably has a transmittance of more than 25%, more preferably more than 30%, more preferably more than 40%, more preferably more than 50% in the visible part of the spectrum (approx. 410–800 nm).

Alternatively, absorbency of bottle may be measured as less than 0.6 (approximately equivalent to 25% transmitting) or by having transmittance greater than 25% wherein % transmittance equals:

$$\frac{1}{10^{absorbancy}} \times 100\,\%$$

For purposes of the invention, as long as one wavelength in the visible light range has greater than 25% transmittance, it is considered to be transparent/translucent.

Enzyme deactivation as a result of UV-damage may occur at very low transmission of UV-B radiation through the container wall.

The container of the present invention may be of any form or size suitable for storing and packaging liquids for household use. For example, the container may have any size but usually the container will have a maximal capacity of 0.05 to 15 L, preferably, 0.1 to 5 L, more preferably from 0.2 to 2.5 L. Preferably, the container is suitable for easy handling. For example the container may have handle or a part with such dimensions to allow easy lifting or carrying the container with one hand. The container preferably has a means suitable for pouring the liquid detergent composition and means for reclosing the container. The pouring means may be of any size of form but, preferably will be wide enough for convenient dosing the liquid detergent composition. The closing means may be of any form or size but usually will be screwed or clicked on the container to close the container. The closing means may be cap which can be detached from the container. Alternatively, the cap can still be attached to the container, whether the container is open or closed. The closing means may also be incorporated in the container.

The following examples are intended to further illustrate the invention and are not intended to limit the invention in any way:

All percentages, unless indicated otherwise, are intended to be percentages by weight.

All numerical ranges in this specification and claims are intended to be modified by the term about.

Finally, where the term comprising is used in the specification or claims, it is not intended to exclude any terms, steps or features not specifically recited.

Methodology

Measurement of Absorbency and Transmittance

Instrument: Milton Roy Spectronic 601

Procedure:

1. Both the spectrophotometer and the power box were turned on and allowed to warm up for 30 minutes.

2. Set the wavelength.

type in the desired wavelength on the keypad (i.e., 590, 640, etc.)

press the [second function] key press the "go to λ"[yes] key machine is then ready to read at the chosen wavelength.

3. Zero the instrument.

press the [second function] key press the "zero A" [% T/A/C]

instrument should then read "XXX NM 0.000 A T"

4. Open the cover, place sample vertically and in front of the sensor.

5. Close the lid and record reading (ex. 640 NM 0.123 A T)

*Note: all readings are taken in "A" mode (absorbency mode)

*Note: zero instrument with every new wavelength change and/or new sample.

Absorbency Values for Two Typical Plastic Bottles

| Wavelength nm | Polyethylene (HDPE); 0.960 mm thickness | Polypropylene (PP); 0.423 mm thickness |
|---|---|---|
| 254 (non-visible) | 1.612 | 1.886 |
| 310 (non-visible) | 1.201 | 0.919 |
| 360 (non-visible) | 0.980 | 0.441 |
| 590 (visible range) | 0.525 | 0.190 |
| 640 (visible range) | 0.477 | 0.169 |

Synthetic Sunlight Box (apparatus used for examples; used only for UVA and UVB range)

Box dimensions and appearance:

Length 4 ft.

Width 2 ft.

Height 2 ft.

Constructed of ¾" plywood. Box sits approximately 2 inches off ground for air circulation. A small fan is located in the cover of the box. Four lamps are mounted on the long side of the box; two on each side set approximately 6 inches apart.

Fan is included so as to maintain the internal temperature throughout the duration of an experiment. This ensures that any effects seen are the result of ultraviolet light alone and not heat.

Samples are placed in open containers and put in box. Open containers are used so as to limit interference of the container material on the light rays. An open container of water is added to the box as well. This water keeps atmosphere at a constant humidity and slows evaporation from the open samples. After a given period of time, samples are removed from the box, reconsidered for the evaporation of water and tested for UV effects.

Accelerated Weathering:

From "sunlight, UV and Accelerated Weathering" Technical Bulletin LU-0822 and QUV Accelerated Weathering Testers form Q-panel Lab Products.

Sunlight is an important cause of damage to plastics, textiles, paints and other organic materials. Although UV light makes up only about 5% of sunlight, it is responsible for most of the photochemical damage. This is because the photochemical effectiveness of light increases with decreasing wavelength. Short wavelength ultraviolet light has long been recognized as responsible for most of this damage. Accelerated weathering testers are widely used for research and development, quality control, and material certification. They employ a variety of light sources to simulate sunlight and the damage cause by sunlight.

To simulate the damage cause by sunlight it is not necessary to reproduce the entire spectrum of sunlight. For most materials, it is only necessary to simulate the short wavelength UV. For our specific purposes, the UVA-340 lamp was chosen. Most of this lamp's emission in the UV-A region, with a small amount in the UV-B. This lamp is an excellent simulation of sunlight from about 370 nm, down to the solar cut-off of 295 nm.

EXAMPLE I

The samples of liquid detergents (set forth in Table 1 below) containing protease and lipase were added to 5" diameter glass dishes with the top off and exposed to UV light of 254 nm and 110 microwatt/cm$^2$ (at 28" from the light source for 5 days). After each 24 hour period, the samples were weighed and topped off to replace evaporated water. Enzyme activity in the samples exposed to UV light was measured using proper substrates (e.g., casein as a protease substrate and p-nitrophenolvalerate as a lipase substrate). Percent remaining activity was calculated based on the initial activity in the sample prior to UV exposure. The formulation was as below.

TABLE 1

A Detergent Formulation

| Ingredient as 100% active | Wt % |
|---|---|
| Neodol 25-9* | 6–8 |
| Alcohol ethoxy sulfate | 12–15 |
| Linear alkylbenzene sulfonate | 6–9 |
| Sodium citrate, dihydrate | 3–6 |
| Propylene glycol | 4–8 |
| Sorbitol | 3–6 |
| Sodium tetraborate pentahydrate | 2–4 |
| Minor additives and water | to 100% |

*$C_{12}$–$C_{15}$ alkoxylated (9EO) chain group

The samples contained either 0.2% UV absorber (Uvinal MS-40) or 0.11% flueresor dye. The control sample contained no such protecting agents. Results were as follow (Table 2):

TABLE 2

Effects of UV Protectants on Enzyme Stability Under UV Light (254 nm) Exposure

| Sample | Enzyme | % Enzyme Remaining after 3 days exposure |
|---|---|---|
| Base + (no protectant (fluorescent dye or UV absorber) | Protease | 38 |
| | Lipase | 54 |
| Base + 0.2% Uvinul MS-40 | Protease | 68 |
| | Lipase | 83 |
| Base + 0.11% flueresor/dye | Protease | 54 |
| | Lipase | 79 |

Similar experiments were carried out in a UV-A/B chamber (UVA=1.01 mW/cm$^2$, UVB=6.17 microW/cm$^2$ at lamp). The HDL's containing enzymes and protecting agents were exposed to UV lights for 4 days. The results were as follow (Table 3):

TABLE 3

Effects of UV Protectants on Enzyme Stability Under UV-A/B Exposure

| Sample | Enzyme | % Enzyme Remaining After 4 days |
|---|---|---|
| Base and no protectant | Protease | 22 |
| | Lipase | 0 |
| Base + 0.2% Uvinul MS-40 | Protease | 36 |
| | Lipase | 93 |
| Base + 0.12% PR f-dye | Protease | 39 |
| | Lipase | 81 |

TABLE 3-continued

Effects of UV Protectants on Enzyme Stability Under UV-A/B Exposure

| Sample | Enzyme | % Enzyme Remaining After 4 days |
|---|---|---|
| Base + 0.1% Uvinul MS-40 | Protease | 43 |
| + 0.12% PR-f-dye | Lipase | 86 |

Tables 2 and 3 above demonstrated that presence of either UV absorber or f-dye increased the stability of both protease and lipase under UV light as shown by % remaining activity.

What is claimed is:

1. A transparent or translucent aqueous heavy duty liquid composition in a transparent bottle comprising;

(a) 10 to 85% by wt. of a surfactant selected from the group consisting of anionic, nonionic, cationic, amphoteric, zwitterionic surfactants and mixtures thereof;

(b) 0.001 to 5% by wt. of an enzyme selected from the group consisting of proteases, lipases, cellulases, oxidases, amylases and mixtures thereof; and (c) 0.001 to 3% of a UV absorber selected from the group consisting of phenyl benzimidazole sulfonic acid, 2-hydroxy4-methoxybenzophenone-5-sulfonic acid, sodium2,2'-dihydroxy-4,4'-dimethoxy-5-sulfobenzophenone, and PEG-25 paraaminobenzoic acid, wherein the transparent composition has about 50% transmittance or greater of light using 1 cm cuvette at wavelength of 410–800 nanometers; and wherein the transparent bottle has light transmittance of greater than 25% at wavelength of about 410–800 nm.

2. The composition of claim 1 further comprising from 0.001% to 1% of a fluorescent dye.

* * * * *